US008505688B2

(12) United States Patent
Campbell et al.

(10) Patent No.: US 8,505,688 B2
(45) Date of Patent: Aug. 13, 2013

(54) MAST LIFT AND MAST LIFT SYSTEM

(75) Inventors: Geoffrey George Campbell, New South Wales (AU); Hugh Lithgow Stark, New South Wales (AU); Alexander (Sandy) McKechran Hardie McNeil, New South Wales (AU); Frank Fornasari, New South Wales (AU)

(73) Assignee: JLG Industries, Inc., McConnellsburg, PA (US)

( * ) Notice: Subject to any disclaimer, the term of this patent is extended or adjusted under 35 U.S.C. 154(b) by 692 days.

(21) Appl. No.: 12/293,759

(22) PCT Filed: Mar. 22, 2007

(86) PCT No.: PCT/US2007/007060

§ 371 (c)(1),
(2), (4) Date: Jul. 21, 2010

(87) PCT Pub. No.: WO2007/111913

PCT Pub. Date: Oct. 4, 2007

(65) Prior Publication Data

US 2010/0294594 A1 Nov. 25, 2010

Related U.S. Application Data

(60) Provisional application No. 60/784,473, filed on Mar. 22, 2006.

(51) Int. Cl.
*E04G 1/18* (2006.01)
*B66F 11/04* (2006.01)

(52) U.S. Cl.
USPC ..... 182/141; 182/148

(58) Field of Classification Search
USPC ..... 182/141, 148
See application file for complete search history.

(56) References Cited

U.S. PATENT DOCUMENTS

| | | | |
|---|---|---|---|
| 460,647 | A | 10/1891 | Mills |
| 788,992 | A | 5/1905 | Bauer |
| 1,744,976 | A | 1/1930 | Levedahl |
| 2,370,834 | A | 3/1945 | Ball |
| 2,907,477 | A | 10/1959 | Coleman |
| 2,938,595 | A | 5/1960 | Miller |
| 2,989,140 | A | 6/1961 | Hill et al. |
| 3,115,211 | A | 12/1963 | Ostrander, Jr. |
| 3,294,182 | A | 12/1966 | Filander et al. |
| 3,313,376 | A | 4/1967 | Holland, Sr. |
| 3,737,007 | A | 6/1973 | Herrell |
| 3,752,263 | A | 8/1973 | Thevenot |

(Continued)

FOREIGN PATENT DOCUMENTS

| | | |
|---|---|---|
| AU | 725451 | 10/2000 |
| DE | 2 029 352 | 12/1971 |

(Continued)

*Primary Examiner* — Alvin Chin Shue
(74) *Attorney, Agent, or Firm* — Nixon & Vanderhye P.C.

(57) ABSTRACT

A lift system is coupled between a work platform and a mast on a mast lift. The lift system includes an overload clutch that slips upon an overload on the lift system, an overrun brake that prevents the lift system from running beyond a fully lowered position and that prevents the lift system from running if the platform is hung up, and an emergency brake. The lift system is safe and lightweight and is effective for controlling a position of the work platform on the mast.

12 Claims, 4 Drawing Sheets

(56) References Cited

U.S. PATENT DOCUMENTS

| | | | | |
|---|---|---|---|---|
| 3,877,543 | A | 4/1975 | Iwata | |
| 3,934,681 | A | 1/1976 | Herrell | |
| 4,015,686 | A | 4/1977 | Bushnell, Jr. | |
| 4,049,081 | A | 9/1977 | McDonald et al. | |
| 4,183,423 | A | 1/1980 | Lewis | |
| 4,194,591 | A | 3/1980 | Fisher | |
| 4,222,140 | A | 9/1980 | Olewinski et al. | |
| 4,269,285 | A | 5/1981 | Ohkoshi et al. | |
| 4,427,093 | A | 1/1984 | Wehmeyer et al. | |
| 4,427,094 | A | 1/1984 | Winkelblech | |
| 4,484,663 | A | 11/1984 | Wyse | |
| 4,488,689 | A | 12/1984 | Councilman | |
| 4,512,440 | A | 4/1985 | Bixby | |
| 4,592,447 | A | 6/1986 | Ream et al. | |
| 4,653,653 | A * | 3/1987 | Scott | 212/278 |
| 4,655,103 | A | 4/1987 | Schreiber et al. | |
| 4,809,572 | A | 3/1989 | Sasaki | |
| 5,044,473 | A | 9/1991 | Gripe | |
| 5,111,907 | A | 5/1992 | Kishi | |
| 5,143,181 | A | 9/1992 | Bixby | |
| 5,180,042 | A | 1/1993 | Ogiso | |
| 5,273,132 | A | 12/1993 | Sasaki et al. | |
| 5,313,765 | A | 5/1994 | Martin | |
| 5,425,433 | A | 6/1995 | Huber | |
| 5,522,583 | A | 6/1996 | Martin | |
| 5,588,496 | A | 12/1996 | Elger | |
| 5,595,265 | A | 1/1997 | Lebrocquy | |
| 5,755,306 | A | 5/1998 | Kraemer et al. | |
| 5,762,556 | A | 6/1998 | Kurian | |
| 5,803,204 | A | 9/1998 | White et al. | |
| 5,850,892 | A | 12/1998 | Citron et al. | |
| 5,890,559 | A | 4/1999 | Busuttil et al. | |
| 5,909,783 | A * | 6/1999 | Berish | 182/146 |
| 5,927,440 | A | 7/1999 | Freeman | |
| 6,095,284 | A | 8/2000 | Smith | |
| 6,174,124 | B1 | 1/2001 | Haverfield et al. | |
| 6,238,159 | B1 | 5/2001 | Pappas | |
| 6,471,004 | B2 | 10/2002 | Stringer et al. | |
| 6,779,635 | B1 | 8/2004 | Anibas | |
| 6,948,392 | B2 | 9/2005 | Eckard et al. | |
| 8,292,039 | B2 * | 10/2012 | Campbell et al. | 187/261 |
| 2007/0104539 | A1 | 5/2007 | Hamilton | |
| 2007/0125599 | A1 * | 6/2007 | Campbell et al. | 182/148 |

FOREIGN PATENT DOCUMENTS

| | | |
|---|---|---|
| EP | 0 192 170 | 8/1986 |
| EP | 0 931 757 | 7/1999 |
| FR | 2 081 769 | 12/1971 |
| GB | 905928 | 9/1962 |
| GB | 2 211 237 | 6/1989 |
| JP | 63-258315 | 10/1988 |
| JP | 2002-167140 | 6/2002 |

* cited by examiner

MAST LIFT AND MAST LIFT SYSTEM

CROSS-REFERENCES TO RELATED APPLICATIONS

This application is the U.S. national phase of International Application No. PCT/US2007/007060 filed 22 Mar. 2007 which designated the U.S. and claims the benefit of U.S. Provisional Patent Application Ser. No. 60/784,473, filed Mar. 22, 2006, the entire content of each of which is herein incorporated by reference.

BACKGROUND OF THE INVENTION

The present invention relates to a personnel lift and, more particularly, to a portable lift machine including a work platform raised and lowered on a mast by a lifting system. The lifting machine may be free-standing or non free-standing, transportable and operable by a single user.

The ladder concept is several thousand years old. Existing ladders, however, can be cumbersome and difficult to maneuver. Additionally, conventional ladders can be unstable particularly on uneven ground, and a work area is limited to the user's reach.

Ladder companies are reluctant to develop powered mechanical products. It would be desirable, however, to develop a personnel lift that achieves many of the advantages of a ladder, e.g., can be set up and used by a single operator, lightweight, etc., while providing for greater stability and a larger working area in a portable powered machine.

Mast climbing platforms are known and typically include a mast that can be free-standing or supported by a wall or other support structure. However, existing mast climbers have minimum SWL loads of 1000 lbs and are not portable or operable by a single user due to their size. Vertical mast products and aerial work platforms include a moving platform and generally are only free-standing assemblies. These machines are also typically too large for portability and are very far from the many advantages provided by a ladder in terms of portability, low cost and ease of use.

To achieve portability, a light weight, reliable lift system mechanism is desirable to provide the functionality expected of a device which lifts personnel.

SUMMARY OF THE INVENTION

A mast lift includes a base or mast frame, a mast on which a carriage supporting a work platform is movable, and a power source, which may be an on-board power pack or a user-supplied source such as a power drill. The various components can also be utilized as part of a modular system where modular components can be used in varying models.

Exemplary features of the carriage and lifting system include the use of an overload clutch in combination with an overrun brake to avoid the lifting mechanism such as a rope or the like from being unwound off a winding drum after reaching the bottom of travel or if encountering an obstacle. An emergency brake secures the work platform in the event of rope failure, movement of which at the bottom of travel serves to both stop the unwinding of the drum and also to provide a latch to hold the carriage in the down position during transport, etc.

An energy absorbing feature may be provided between the platform and the carriage that reduces the peak load that can be exerted on the structure. This feature provides a type of crumple zone in the unlikely event of complete hoist system and brake failure.

Another exemplary feature is spring-mounted stepped rollers for a telescopic mast.

In an exemplary embodiment of the invention, a mast lift, includes a mast supported on a mast base, a work platform movably secured to the mast, and a lift system coupled between the work platform and the mast. The lift system effects raising and lowering of the work platform on the mast. The lift system includes an overload clutch that slips upon at least one of an overload on the lift system or upon reaching end of travel, an overrun brake that prevents the lift system from running beyond a fully lowered position, and an emergency brake. The overrun brake may also prevent the lift system from running if the platform is hung up.

Preferably, the lift system additionally includes a worm drive gear box operably connected to a hoist drum, where the gear box is driven via a drive shaft coupleable with a drive source. At least one lifting rope, preferably two, is windable on the hoist drum from one end and secured to the mast at an opposite end. A secondary brake or inertia device may be included in series with the worm drive.

In one embodiment, the emergency brake is biased toward an engaged position, wherein the lifting rope is cooperable with the emergency brake such that tension on the lifting rope maintains the emergency brake in a disengaged position. An energy absorbing member may be mounted between the work platform and the mast base.

The drive source may be one of a power pack or a hand-held power drill. The drive shaft is preferably biased toward a disengaged position such that activation of the drive shaft may require an opposite force against the bias.

The overrun brake preferably includes a brake lever cooperable with a dog clutch, wherein upon a loss of tension in the lifting rope, the brake lever displaces the dog clutch into engagement with the worm drive, thereby stalling the worm drive gear box. In this context, the dog clutch may be a one way dog clutch that permits the platform to be lifted and prevents the platform from being lowered.

Preferably, a weight of the lift system is about 30 lbs.

In one embodiment, the mast based is structured such that the mast lift is free-standing.

BRIEF DESCRIPTION OF THE DRAWINGS

These and other aspects and advantages of the present invention will be described in detail with reference to the accompanying drawings, in which.

DETAILED DESCRIPTION OF THE DRAWINGS

Figure 1:
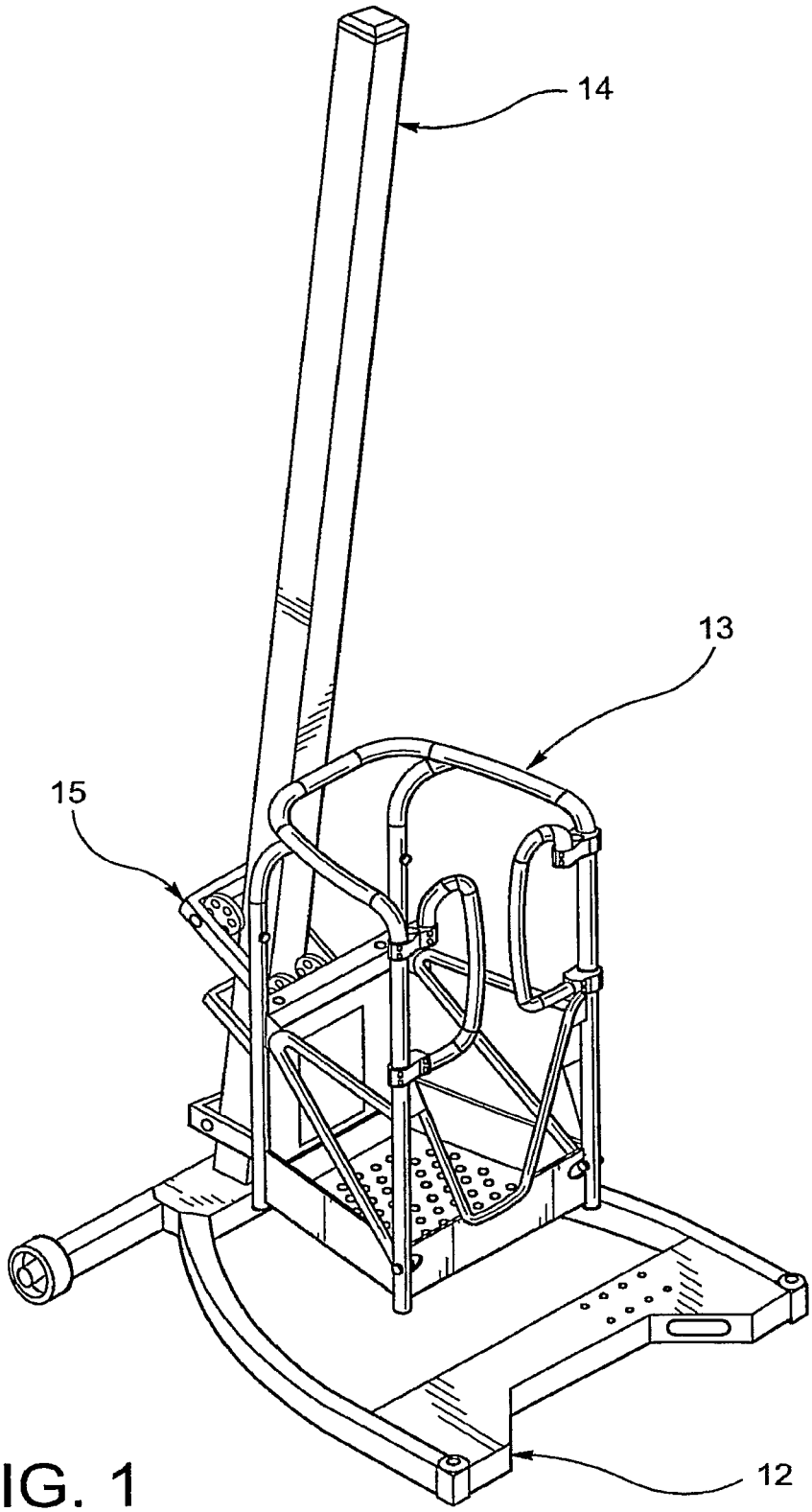
FIG. 1 is a perspective view of the mast lift according to an exemplary configuration.

With reference to FIG. 1, the mast lift described herein generally includes a base or mast frame 12 supporting a mast 14 on which a work platform 13 is movable between a lowered position (shown in FIG. 1) and a raised position via a carriage assembly or lift system 15. Preferably, the components are modular, thereby enabling the machine to be quickly and reliably assembled and disassembled for ease of transport by one person. Component assembly typically takes the average skilled worker less than 30 seconds. The modular system also allows various components to be used on different types of mast and base designs, increasing product versatility. In an alternative embodiment, the mast 14 includes telescoped sections to provide for a greater height mast that can retract to be more compact for transport. The mast lift shown in FIG. 1 is a free-standing mast lift, i.e., the machine is capable of independent support and positioning. The components of the lifting structure described below are equally applicable to a non free-standing machine, and the invention is not necessarily meant to be limited to the illustrated exemplary free-standing lift embodiment.

The base or mast frame 12 is provided with a one-way retracting castor system. This ensures no castor spring effect when a user is on the platform. When empty, a simple activation activates the castor for ease of movement of the lift to a working position.

Figure 2:
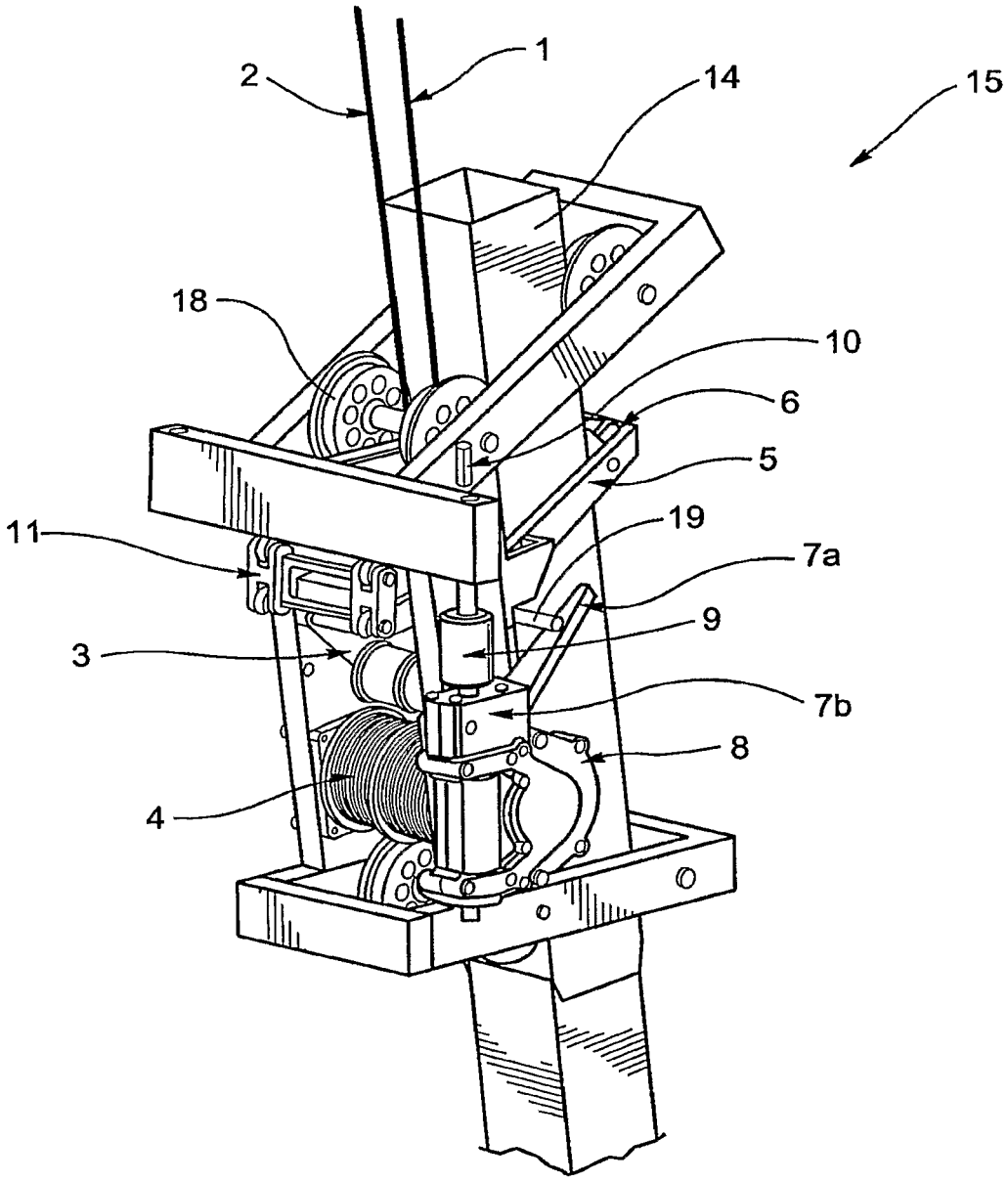
FIG. 2 is a front perspective view of a lifting system for the mast lift.
Figure 3:
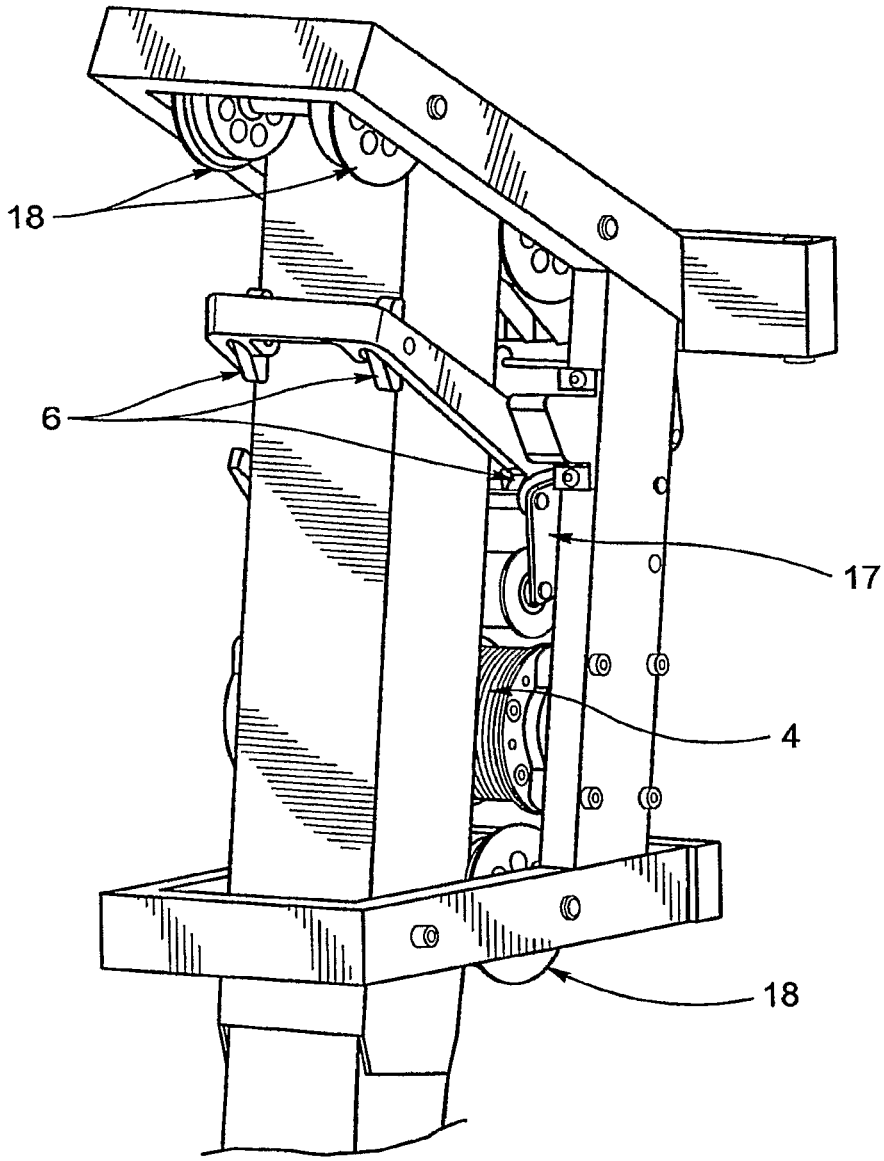
FIG. 3 is a rear perspective view of the lifting system.

The work platform 13 is secured to the carriage or lift system 15 via mounting pins, a hook and a latch, all of which engage a simple assembly operation that takes less than ten seconds to complete safely, and cannot readily be incorrectly assembled in an unsafe manner. With reference to FIGS. 2 and 3, one or preferably two lifting ropes 1, 2 are connected at the top of the mast 14 via a tension equalizing loop (not shown) that ensures equal tension on each rope while maintaining independent rope terminations at the top of the mast 14. The ropes 1, 2 extend along the front of the mast 14 and into the carriage 15. Rollers 18 mount the carriage 15 onto the mast 14 and also ensure that the platform 13 does not rotate around the mast 14. The rollers 18 are preferably stepped and spring-loaded to act on the telescopic variation.

The ropes 1, 2 pass over an emergency brake release idler roller 3 before being wrapped onto a main hoist drum 4. Platform lift is achieved by a worm drive gear box 8 turning the hoist drum 4 to wind the dual lifting ropes 1, 2. In a preferred embodiment, the hoist drum 4 is grooved to help ensure that the ropes 1, 2 wind onto the drum 4 at a constant diameter until the middle of the drum is reached, after which the ropes 1, 2 roll back onto themselves.

The worm drive gear box 8 is driven via a drive shaft 10, which may be activated by a modular power pack or alternatively via a hand-held power drill or the like. The drive shaft 10 is provided with two-action operation, requiring the shaft to be pushed down to engage the worm drive gear box 8 and rotated. Using a hand-held power drill, the two-action activation requires that the operator push down on the shaft and pull the trigger on the drill to move the platform 13. The operator is protected from excessive backlash if he fails to activate the second action via the overload clutch, which slips if the second action is not properly completed. With the power pack, securing the power pack to the drive shaft 10 fixes the drive shaft in the pushed down position for activation. The gear box 8 preferably also has an output on the bottom side to allow manual descent from underneath in the event of an incapacitated operator.

Tension on the lifting ropes 1, 2 exerts a force through the idler roller 3 on a bell crank 17, which operates in cooperation with an emergency brake frame 5 and its mounting link 11 to cause brake shoes 6 to be released from the mast 14 and remain released from the mast 14 while tension remains on the lifting ropes 1, 2. As such, this configuration permits the carriage 15 to move freely in normal use.

In the event that tension in the ropes 1, 2 is lost, springs attached between the top front roller 18 axle and the brake frame 5 via the link 11 cause the brake shoes 6 to come in contact with the mast 14, and due to the high friction between the shoes 6 and the mast 14, a cross-binding of the front and rear brake shoes will occur around the mast 14, and the emergency brake frame 5 engaged on the mast 14. The load on the platform 13 is then no longer supported by tension in the ropes 1, 2, but rather is supported via the mounting link 11, the emergency brake frame 5 and the brake shoes 6.

Figure 4:
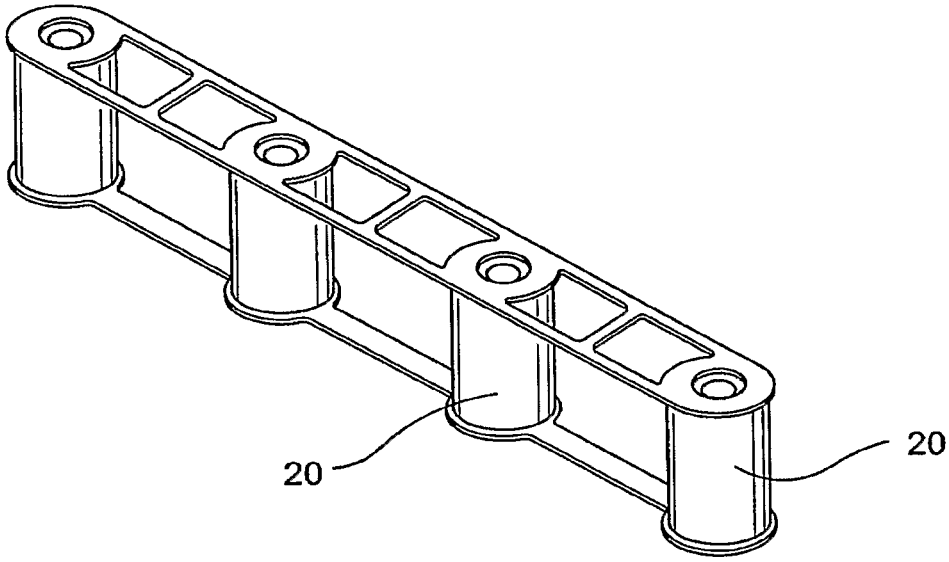
FIG. 4 shows an energy absorbing member.

The system is designed so that the emergency brake engages within a very short amount of fall following loss of tension in the lifting ropes 1, 2, which helps to minimize the impact forces from activation of the emergency brake. Energy from the rapid deceleration caused by the engagement of the self-energizing emergency brake could be damaging to the machine given the high peak forces that can be applied in an emergency engagement of the brake. The configuration described herein minimizes the extent of peak loading by incorporating an energy absorbing member 20 such as energy absorbing rubber springs mounted between the carriage 15 and the platform 13 as shown in FIG. 4. An additional benefit of the energy absorbing rubber springs 20 when combined with other features in the design is a crumple zone effect to restrain the maximum G forces on the user in the event of catastrophic failure (akin to a crumple zone in a modern car).

With continued reference to FIGS. 2 and 3, an overload clutch 9 operates on the drive shaft 10 to ensure that no more than a maximum safe working load plus a small margin can be lifted by the hoist drum 4. The overload clutch 9 operates on the torque into the gear box 8 via the drive shaft 10 in a preferred embodiment of the concept but could be incorporated in another part of the drive chain to achieve the same outcome. Any suitable device could be used for the overload clutch 9, and the invention is not meant to be limited to a specific design. In one construction, a series of washers or the like in an oil bath serve as an overload clutch, wherein upon application of a predetermined load (torque), the washers slip relative to one another.

An over-run brake 7 is also incorporated in the drive train. The over-run brake 7 acts to stop the lifting ropes 1, 2 from being wound off the drum 4 when the machine is fully lowered to the bottom of travel and also in the unlikely event of the platform 13 being hung up on an obstacle during downward travel. The over-run brake 7 senses a loss of tension in the emergency brake mechanism via a pin 19 acting on a lever arm 7*a*, which is spring loaded to engage the emergency brake frame 5. When tension is lost in the ropes 1, 2, normally only due to reaching the bottom of travel, the emergency brake frame 5 moves, which causes an over-run brake lever 7*a* to lower a dog-clutch 7*b* onto the drive shaft 10 so that the drive shaft 10 is stalled. Power from the drive motor then is absorbed into the overload clutch 9, which creates a noise that should lead the operator to stop operating the motor.

The dog-clutch 7*b* is preferably a one-way dog-clutch device that allows travel in the lift up direction when it is activated, and prevents travel in the lift down direction when it is activated, hence avoiding the ropes 1, 2 running out or winding to the end of the drum 4. This design means that the operator can lift up from a position in which the over-run brake 7 is engaged as this in turn creates tension on the ropes 1, 2, which in turn releases the emergency brake and releases the over-run brake 7.

Movement of the idler roller 3 is related to movement of the emergency brake. At the bottom of travel, the idler roller mount is utilized to latch the carriage 15 to the mast 14 in the lowered position. This provides an added benefit of ensuring that the carriage does not move when the mast is lifted off the base holding the carriage. It also stops the carriage from moving along the mast during transport.

The overall result of the design is a carriage that can climb a mast with two lift ropes plus an emergency brake, plus control of overload, end of travel control, over-run control and auto on/off lock down latch at the bottom of travel. The simple mechanism includes all these features yet weighs only about 30 lbs.

As described, the configuration achieves these important safety and operational functions without the use of any electric or electronic devices, thereby keeping the design simple from a cost, weight and maintenance perspective. As would be apparent to those of ordinary skill in the art, however, use of electric or electronic devices to perform these functions is possible, and the invention is not necessarily meant to be limited to the described configuration.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A mast lift comprising:

a mast supported on a mast base;

a work platform movably secured to the mast; and a lift system coupled between the work platform and the mast, the lift system effecting raising and lowering of the work platform on the mast and including:

an overload clutch that slips upon at least one of an overload on the lift system or at end of travel, an overrun brake that prevents the lift system from running beyond a fully lowered position, an emergency brake biased toward an engaged position, at least one lifting rope windable on a hoist drum from one end and secured to the mast at an opposite end, and an idler roller coupled with the emergency brake and disposed between the opposite end of the mast and the hoist drum, the idler roller being cooperatively engageable with the at least one lifting rope such that the tension in the lifting rope displaces the idler roller to maintain the emergency brake in a disengaged position.

2. A mast lift according to claim 1, wherein the lift system comprises:

a worm drive gear box operably connected to the hoist drum, the gear box being driven via a drive shaft coupleable with a drive source.

3. A mast lift according to claim 1, wherein the lift system comprises two lifting ropes.

4. A mast lift according to claim 1, further comprising an energy absorbing member mounted between the work platform and the mast base.

5. A mast lift according to claim 2, wherein the drive source is one of a power pack or a hand-held power drill.

6. A mast lift according to claim 5, wherein the drive shaft is biased toward a disengaged position such that activation of the drive shaft requires an opposite force against the bias.

7. A mast lift according to claim 2, wherein the overrun brake comprises a brake lever cooperable with a dog clutch, and wherein upon a loss of tension in the lifting rope, the brake lever displaces the dog clutch into engagement with the worm drive gear box, thereby stalling the worm drive gear box.

8. A mast lift according to claim 7, wherein the dog clutch comprises a one way dog clutch that permits the platform to be lifted and prevents the platform from being lowered.

9. A mast lift according to claim 1, wherein a weight of the lift system is about 30 lbs.

10. A mast lift according to claim 1, wherein the mast base is structured such that the mast lift is free-standing.

11. A mast lift according to claim 1, wherein the overrun brake is structured to prevent the lift system from running if the platform is hung up.

12. A lift system coupleable between a work platform and a mast, the lift system effecting raising and lowering of the work platform on the mast, wherein the lift system comprises:

an overload clutch that slips upon at least one of an overload on the lift system or upon reaching end of travel;

an overrun brake that prevents the lift system from running beyond a fully lowered position;

an emergency brake biased toward an engaged position;

at least one lifting rope windable on the hoist drum from one end and securable to the mast at an opposite end; and an idler roller coupled with the emergency brake, the idler roller being cooperatively engageable with the at least one lifting rope such that the tension in the lifting rope displaces the idler roller to maintain the emergency brake in a disengaged position.

* * * * *